US011465305B2

(12) United States Patent
O'Connor et al.

(10) Patent No.: US 11,465,305 B2
(45) Date of Patent: Oct. 11, 2022

(54) SHAVING RAZOR CARTRIDGE

(71) Applicant: The Gillette Company, Boston, MA (US)

(72) Inventors: William Thomas O'Connor, Londonderry, NH (US); William Owen Jolley, Spencer, MA (US); Kelly Daniel Bridges, Quincy, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/989,301

(22) Filed: Aug. 10, 2020

(65) Prior Publication Data

US 2020/0368927 A1 Nov. 26, 2020

Related U.S. Application Data

(63) Continuation of application No. 15/063,971, filed on Mar. 8, 2016, now Pat. No. 10,773,404.

(60) Provisional application No. 62/160,819, filed on May 13, 2015.

(51) Int. Cl.

| | |
|---|---|
| ***B26B 21/40*** | (2006.01) |
| ***B26B 21/56*** | (2006.01) |
| ***B26B 21/22*** | (2006.01) |
| ***B26B 21/44*** | (2006.01) |

(52) U.S. Cl.

CPC ..... *B26B 21/4031* (2013.01); *B26B 21/222* (2013.01); *B26B 21/225* (2013.01); *B26B 21/4012* (2013.01); *B26B 21/4018* (2013.01); *B26B 21/4068* (2013.01); *B26B 21/443* (2013.01); *B26B 21/565* (2013.01)

(58) Field of Classification Search

CPC . B26B 21/4031; B26B 21/222; B26B 21/225; B26B 21/4012; B26B 21/4018; B26B 21/4068; B26B 21/443; B26B 21/565

See application file for complete search history.

(56) References Cited

U.S. PATENT DOCUMENTS 4,245,388 A * 1/1981 Dawidowicz ..... B26B 21/165 30/47
5,253,420 A * 10/1993 Althaus ..... B26B 21/227 30/47
5,305,526 A * 4/1994 Althaus ..... B26B 21/4006 30/346.54

(Continued)

OTHER PUBLICATIONS

All Office Actions, U.S. Appl. No. 15/063,971.
PCT Search Report with Written Opinion in corresponding international application PCT/US2016/032067 dated Jul. 29, 2016.

*Primary Examiner* — Evan H Macfarlane
*Assistant Examiner* — Liang Dong
(74) *Attorney, Agent, or Firm* — John M. Lipchitz

(57) ABSTRACT

A method of assembling a razor cartridge. A housing is injection molded. An elastomer is co-injection molded to the housing forming a pair of laterally spaced apart blade stabilizers. A primary blade member having a cutting edge is mounted to the housing. The cutting edge of the primary blade member is contacted with the laterally spaced apart blade stabilizers. A blade retention member is mounted to a top surface of the housing. A pair of lateral ends of the cutting edge of the primary blade member is constrained between the blade retention member and the pair of laterally spaced apart blade stabilizers.

8 Claims, 5 Drawing Sheets

(56) References Cited

U.S. PATENT DOCUMENTS

| | | | | |
|---|---|---|---|---|
| 6,295,734 | B1 | 10/2001 | Gilder | |
| 6,430,818 | B1 * | 8/2002 | Wonderley | B26B 21/222 30/41 |
| 6,574,866 | B2 | 6/2003 | Pragt et al. | |
| 6,880,253 | B1 | 4/2005 | Gyllerstrom | |
| 8,146,255 | B2 | 4/2012 | Denkert et al. | |
| 10,773,404 | B2 | 9/2020 | O'connor et al. | |
| 2004/0128835 | A1 * | 7/2004 | Coffin | B26B 21/14 30/527 |
| 2009/0019365 | A1 | 1/2009 | Zeng | |
| 2009/0193659 | A1 | 8/2009 | Park et al. | |
| 2011/0225828 | A1 * | 9/2011 | Bruno | B26B 21/4012 30/50 |
| 2011/0308089 | A1 | 12/2011 | Bridges | |
| 2012/0324737 | A1 * | 12/2012 | Howell | B26B 21/4018 30/50 |
| 2013/0020559 | A1 | 1/2013 | Kitamura | |
| 2013/0020595 | A1 | 1/2013 | Moriguchi | |
| 2013/0205595 | A1 | 8/2013 | Bykowski | |
| 2014/0000114 | A1 | 1/2014 | Wester et al. | |
| 2015/0298327 | A1 * | 10/2015 | Tomassetti | B26B 21/56 30/34.05 |

* cited by examiner

SHAVING RAZOR CARTRIDGE

FIELD OF THE INVENTION

The present invention relates to wet shaving safety razors and more particularly to shaving cartridges that have a housing for retaining and/or fixing one or more blades.

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled.

Razor blade assemblies have been disclosed wherein cutting edge portions of the blade members are held between skin engaging surfaces which are generally referred to as the guard and cap of the razor blade assembly. The guard contacts the skin in front of the blade member(s) and the cap contacts the skin behind the blade member(s) during a shaving stroke. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

In U.S. Pat. Nos. 4,586,255 and 4,378,634, the blade members are disclosed that are independently movable in response to forces encountered during the shaving operation by virtue of their being supported by spring finger biasing members integral with the body member, which exercise a bias against the blades during the shaving operation. In addition, mounting the blades on spring members, such as cantilever beams, may also be used to set the blade geometry by biasing the blades against a registration surface, such as clips.

In the construction wherein the blade support spring finger biasing members are formed integral with the body member, it is necessary to choose a material for the body member which demonstrates the proper qualities to provide a spring member, yet will demonstrate those qualities of durability necessary to provide a suitable housing for the blades, the cap and guard portion of the blade assembly. While plastic materials have been found which contain these particular qualities, regardless of the plastic which is used in the housing, when employed as a spring the material is susceptible to creep to a greater degree than that of a metal such as spring steel. However, metal or steel mechanisms increase cost and complexity of shaving cartridges.

Blades and blade support members are becoming thinner to provide for improved rinsing and cutting efficiency. However, thinner blades and blade support members have a tendency to move more during a shaving stroke, which may negatively impact shaving performance. Accordingly, it is more difficult to sufficiently constrain the blades and/or blade support members, as well as prevent damage to the blades and/or blade support members during the process. In addition, the shaving forces may vary depending on the location of the particular blades and/or blade support members within the housing.

Thus, there is a need for a shaving razor cartridge having a simple and reliable design to sufficiently constrain the blades, and more particularly where the most force is applied during a shaving stroke. What is also needed is a method and design to constrain the blades and/or blade support members in relation to forces encountered during the shaving operation without damaging the blades and/or blade supports.

SUMMARY OF THE INVENTION

In one aspect, the invention features, in general a shaving razor cartridge with a housing having a guard and a cap. A pair of laterally spaced apart blade stabilizers are on the housing. A primary blade member is positioned between the guard and the cap. A blade retention member is mounted to a top surface of the housing. The primary blade member has a cutting edge constrained between the blade retention member and the pair of laterally spaced apart blade stabilizers.

In another aspect, the invention features, in general a method of assembling a shaving razor cartridge. At least one blade is mounted to a housing having a pair of laterally spaced apart blade stabilizers. A blade retention member is mounted to a top surface of the housing. A cutting edge of the blade is constrained between the blade retention member and the pair of laterally spaced apart blade stabilizers.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
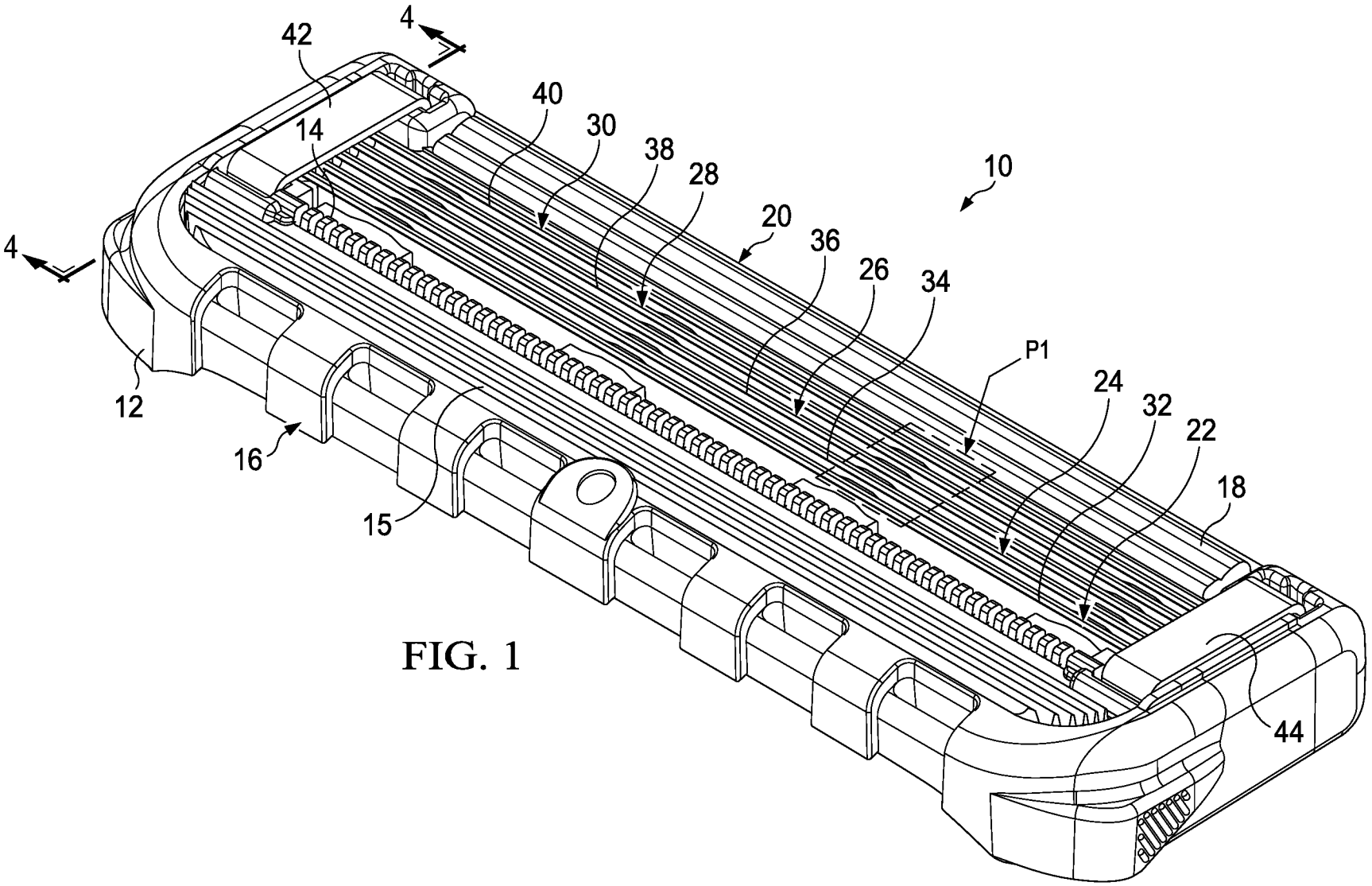
FIG. 1 is a perspective view of a shaving razor cartridge according to one possible embodiment of the present invention.

Referring to FIG. 1, a perspective view of a shaving razor cartridge 10 is shown. The shaving razor cartridge 10 may be mounted to a handle (not shown). The shaving razor cartridge 10 may be removable or permanently mounted to the handle. For example, the shaving razor cartridge 10 may be mounted detachably on a handle to enable the shaving razor cartridge 10 to be replaced by a fresh shaving razor cartridge 10 when the blade sharpness has diminished to an unsatisfactory level, or it may be attached permanently to the handle with the intention that the entire razor be discarded when the blade or blades have become dulled. The shaving razor cartridge 10 may include a housing 12. A guard 14 may be positioned at a front portion 16 of the housing 12 and a cap 18 may be positioned at a rear portion 20 of the housing 12. In certain embodiments, the cap 18 may comprise one or more lubricants that are released during shaving.

The guard 14 is typically a unitary elongated member that can be formed of a rigid plastic (e.g., the same material as the housing 12). The guard 14 may be a solid or segmented bar that extends generally parallel to the cap 18 to help support the skin during a shaving stroke. In certain embodiments, the housing 12 may comprise a skin-engaging member 15 (e.g., a plurality of fins or other protrusions) in front of the guard 14 for stretching the skin during a shaving stroke. In certain embodiments, the skin-engaging member 15 may be insert injection molded or co-injection molded to the housing 12. However, other known assembly methods may also be used such as adhesives, ultrasonic welding, or mechanical fasteners. The skin engaging member 15 may be molded from a softer material (i.e., lower durometer hardness) than the housing 12, such as an elastomer.

One or more of the blade members 22, 24, 26, 28 and 30 may be mounted to the housing 12 between the cap 18 and the guard 14 (i.e., in front of the cap 18 and behind the guard 14). The blade members 22, 24, 26, 28 and 30 may each have a respective cutting edge 32, 34, 36, 38 and 40 generally directed towards the guard 14. The blade member 22 nearest the guard 14 may be known as the primary blade member 22, the next nearest the guard 14 known as the secondary blade member 24, and so on until the fifth blade member 30 is furthest from the guard 14 (e.g., closest the cap 18). Although five blade members 22, 24, 26, 28 and 30 are shown, the shaving razor cartridge 10 may have more or fewer blades depending on the desired performance and cost of the shaving razor cartridge 10. The guard 14 and the cap 18 may define a shaving plane P1 that is tangent to the guard 14 and the cap 18. As will be described in greater detail below, the blade members 22, 24, 26, 28 and 30 may be secured to the housing 12 with one or more blade retention members 42 and 44. In certain embodiments, the blade retention members 42 and 44 may be metal or plastic clips. The blade retention members 42 and 44 may be spaced apart from each other (e.g., on opposites sides of the housing 12). In certain embodiments, the blade retention members 42 and 44 may be spaced apart, but still interconnected by a strip of material (e.g., metal) that comprises the blade retention members 42 and 44. The blade retention members 42 and 44 may also aid in establishing the exposure of the blades (i.e., the position of the cutting edges 32, 34, 36, 38 and 40 relative to the shaving plane P1). As will be explained in greater detail below, the cutting edges 32, 34, 36, 38 and 40 may be biased against the blade retention members 42 and 44.

Figure 2:
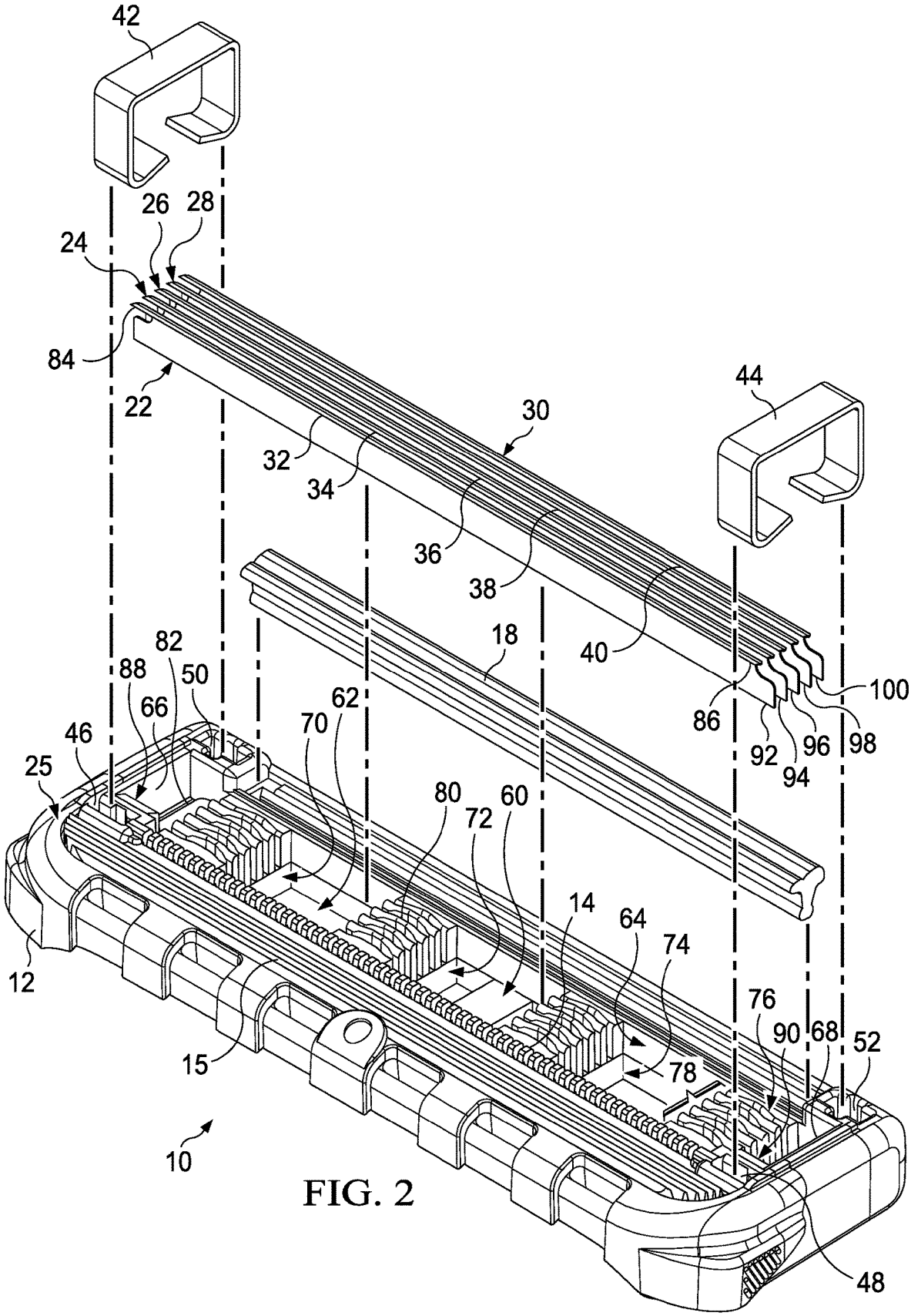
FIG. 2 is an assembly view of the shaving razor cartridge of FIG. 1.

Referring to FIG. 2, an assembly view of the shaving razor cartridge 10 is illustrated. The housing 12 may be injection molded from a polymeric material or may comprise other materials, such as metal. The housing 12 may be molded from polymers such as high impact polystyrene (HIPS), but other semi-rigid polymers such as polypropylene (PP), nylon, acrylonitrile butadiene styrene (ABS), polyphenylene ether, polystyrene, and combinations thereof may also be used. The housing 12 may have a top surface 25 that defines a pair of openings 46 and 48 adjacent the guard 14. The guard 14 may be positioned between the pair of openings 46 and 48. The housing 12 may also define a second pair of openings 50 and 52 adjacent the cap 18. For example, the cap 18 may be positioned between the pair of openings 50 and 52. The housing 12 may define an interior space 60 for positioning the blade members 22, 24, 26, 28 and 30. The interior space 60 may be defined by a front interior wall 62, a rear interior wall 64, and a pair of lateral interior walls 66 and 68. A plurality of intermediate walls 70, 72, 74 and 76 may be positioned within the interior space 60, interconnecting the front interior wall 60 and the rear interior wall 62. Each of the intermediate walls 70, 72, 74 and 76 may define one or more slots 78 each dimensioned to receive one of the blade members 22, 24, 26, 28 and 30.

The housing 12 may have a pair of spaced apart blade registration members 80 and 82 positioned within the interior space 60. The blade registration members 80 and 82 may be spaced apart from each other (e.g., on opposites sides of the housing 12) to allow for sufficient rinsing between the blade members 22, 24, 26, 28 and 30. For example, in certain embodiments, the blade registration members 80 and 82 may be spaced apart, but still interconnected by a strip of elastomeric material that comprises the blade registration members 80 and 82. The blade registration members 80 and 82 may be mounted to the housing 12. A pair of spaced apart blade stabilizers 88 and 90 may extend from the respective blade registration members 80 and 82 toward the top surface 25 of the housing 12. The blade stabilizers 88 and 90 may be spaced apart from each other (e.g., on opposites sides of the housing 12) to allow for a sufficient cutting length for the cutting edge 12. For example, in certain embodiments, the blade stabilizers 88 and 90 may be spaced apart, but still interconnected by a strip of elastomeric material that comprises the blade stabilizers 88 and 90. One of the blade stabilizers 88 may be positioned behind the opening 46 and the other blade stabilizer 90 may be positioned behind the opening 48. In certain embodiments, the pair of laterally spaced apart blade stabilizers 88 and 90 may be positioned immediately behind and generally aligned (e.g., overlapping) with the respective openings 46 and 48.

The blade registration members 80 and 82 and the pair of laterally spaced apart blade stabilizers 88 and 90 may be co-injection molded to the housing 12. A first shot of rigid plastic may form the housing 12. A second shot of a softer plastic (e.g., elastomeric material) may form the blade registration members 80 and 82, the pair of laterally spaced apart blade stabilizers 88 and 90 and the skin engaging member 15 and/or other surfaces on the housing 12. The co-injection molding process may bond the blade registration members 80 and 82 and the pair of laterally spaced apart blade stabilizers 88 and 90 to the housing 12. Alternatively, the blade registration members 80 and 82 (along with the blade stabilizers 88 and 90 may be separate components that are secured to the housing. For example, the blade registration members 80 and 82 and the pair of laterally spaced apart blade stabilizers 88 and 90 may be secured to the housing 12 with adhesive, press fit, ultrasonically welded and/or snap fit to the housing 12.

The blade members 22, 24, 26, 28 and 30 may be mounted to the housing 12. For example, the blade members 22, 24, 26, 28 and 30 may be positioned in the respective blade slots 78. The spaced apart blade registration members 80 and 82 may contact a bottommost portion 92, 94, 96, 98 and 100 of the respective blade members 22, 24, 26, 28 and 30 to push the respective cutting edges 32, 34, 36, 38 and 40 up against the blade retention members 42 and 44 to establish the shaving geometry for the shaving cartridge 10. The cutting edge 32 of the primary blade 22 may have a pair of lateral end portions 84 and 86. In certain embodiments, the blade stabilizers 88 and 90 may contact and/or be bonded to the front interior wall 62 of the housing and/or one of the lateral interior side walls 66 and 68 to provide additional support and rigidity.

Figure 3:
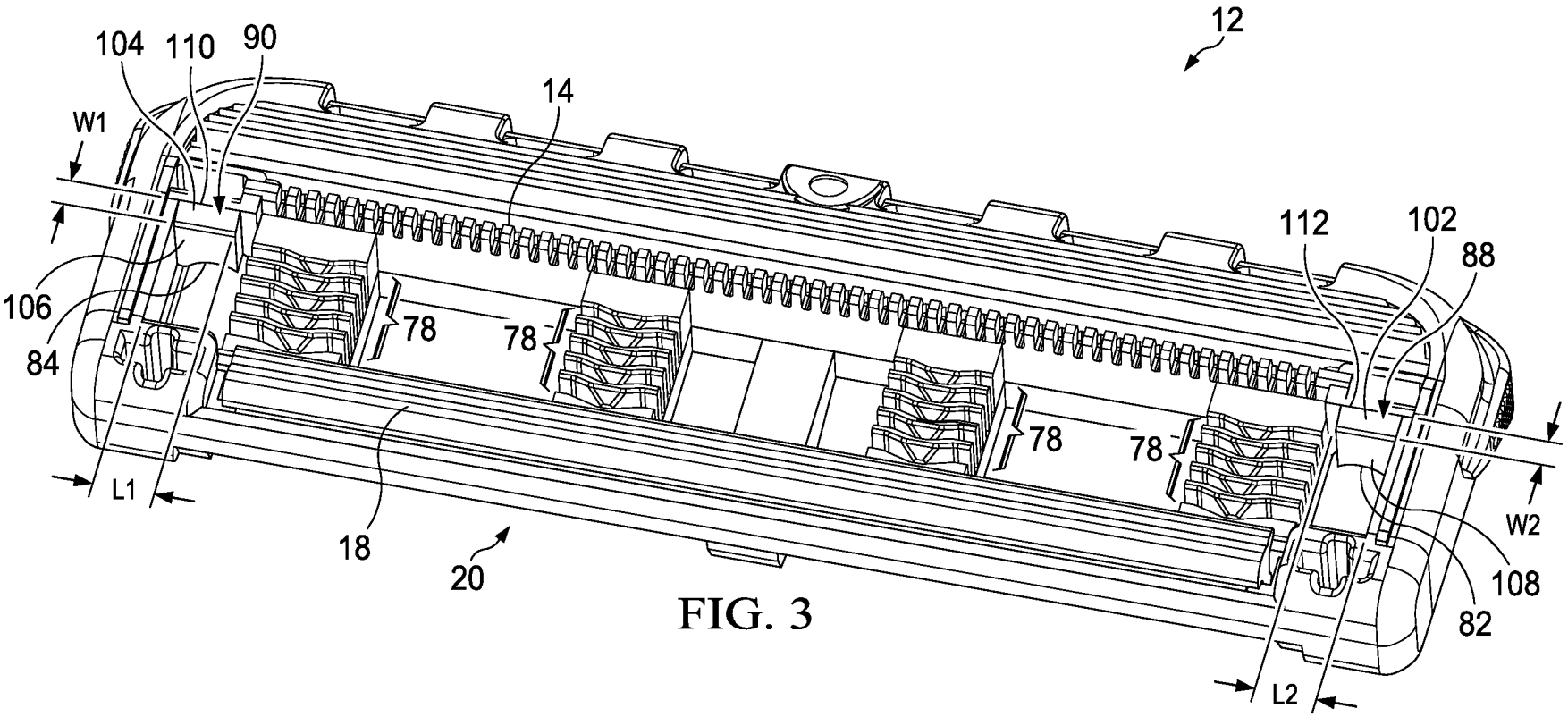
FIG. 3 is a perspective view of a housing that may be incorporated into the shaving razor cartridge of FIG. 2.

Once the blade members 22, 24, 26, 28 and 30 are mounted within the housing 12 (e.g., positioned within the corresponding slots 78), the blade retention members 42 and 44 may be inserted into the corresponding openings 46, 48, 50 and 52 and secured to the housing 12. The blade registration members 80 and 82 may bias the cutting edges 32, 34, 36, 38 and 40 against the blade retention members 42 and 44. The blade stabilizers 88 and 90 may also aid in biasing the cutting edge 32 against the blade retention members 42 and 44. The pair of lateral end portions 84 and 86 of the blade edge 32 may be positioned between the respective blade stabilizers 88 and 90 and blade retention members 42 and 44 to facilitate securement of the blade edge 32. For example, the respective lateral ends 84 and 86 of the primary blade member 22 may rest on a respective top surface 102 and 104 (as shown in FIG. 3) of the blade stabilizers 88 and 90. The cutting edge 32 of the primary blade member 22 may be constrained at the lateral ends 84 and 86 of the cutting edge 32 to minimize movement of the cutting edge 32 (e.g., flexing or bending), which may negatively impact shaving performance. Furthermore, constraining the lateral ends 84 and 86 of the cutting edge 32 under the blade retention members 42 and 44 may allow for an increased shaving efficiency and rinsibility because the area of the cutting edge 32 located beneath the blade retention members 42 and 44 is not used for cutting hair and may also hamper rinsing. For example, if the entire length of the cutting edge 32 was supported by the blade stabilizers 88 and 90, then the cutting edge 32 would not be exposed to cut hair. The pair of laterally spaced apart blade stabilizers 88 and 90 may contact the cutting edge 32 of the primary blade member 22 to further limit movement of the primary blade member 22 and more specifically the blade edge 32 during shaving. The spaced apart blade stabilizers 88 and 90 may facilitate clamping the cutting edge 32 of the primary blade 22 to improve blade retention and reduce blade edge damage during assembly.

Referring to FIG. 3, a perspective view of the housing 12 is illustrated. The pair of laterally spaced apart blade stabilizers 88 and 90 may each have a respective top surface 102 and 104 that declines (e.g., slant downward) in a direction toward the rear 20 of the housing 12. In certain embodiments, the top surface 102 and 104 may have an included angle of about 18 degrees to about 23 degrees (e.g., 16 to 26 degrees) to facilitate supporting the primary blade member 22 (not shown). The spaced apart blade stabilizers 88 and 90 may be positioned inboard of the guard 14 and the cap 18 (i.e., between the guard 14 and the cap 18) in a front-rear direction and outboard from the guard 14 and the cap 18 in a lateral direction. At least one of the spaced apart blade stabilizers 88 and 90 may be positioned outboard and spaced apart from the blade slots 78 to improve securement of the blade members (not shown).

In certain embodiments, the blade stabilizers 88 and 90 may have a respective width W1 and W2 from a respective front wall 106 and 108 to a respective rear wall 110 and 112 of the of blade stabilizers 88 and 90 of about 0.25 mm to about 2.0 mm and more preferably about 0.5 mm to about 1.0 mm. The widths W1 and W2 of the blade stabilizers 88 and 90 may provide sufficient support and retention of the cutting edge 32 (not shown) while also allowing sufficient room for assembly of the secondary blade member 24 (not shown). The blade stabilizers 88 and 90 may also have a respective length L1 and L2 of about 0.4 mm to 4 mm. The length of the blade stabilizers 88 and 90 may provide sufficient support and retention of the cutting edge 32 (not shown) while also maximizing the effective cutting length of the cutting edge 32.

Figure 4:
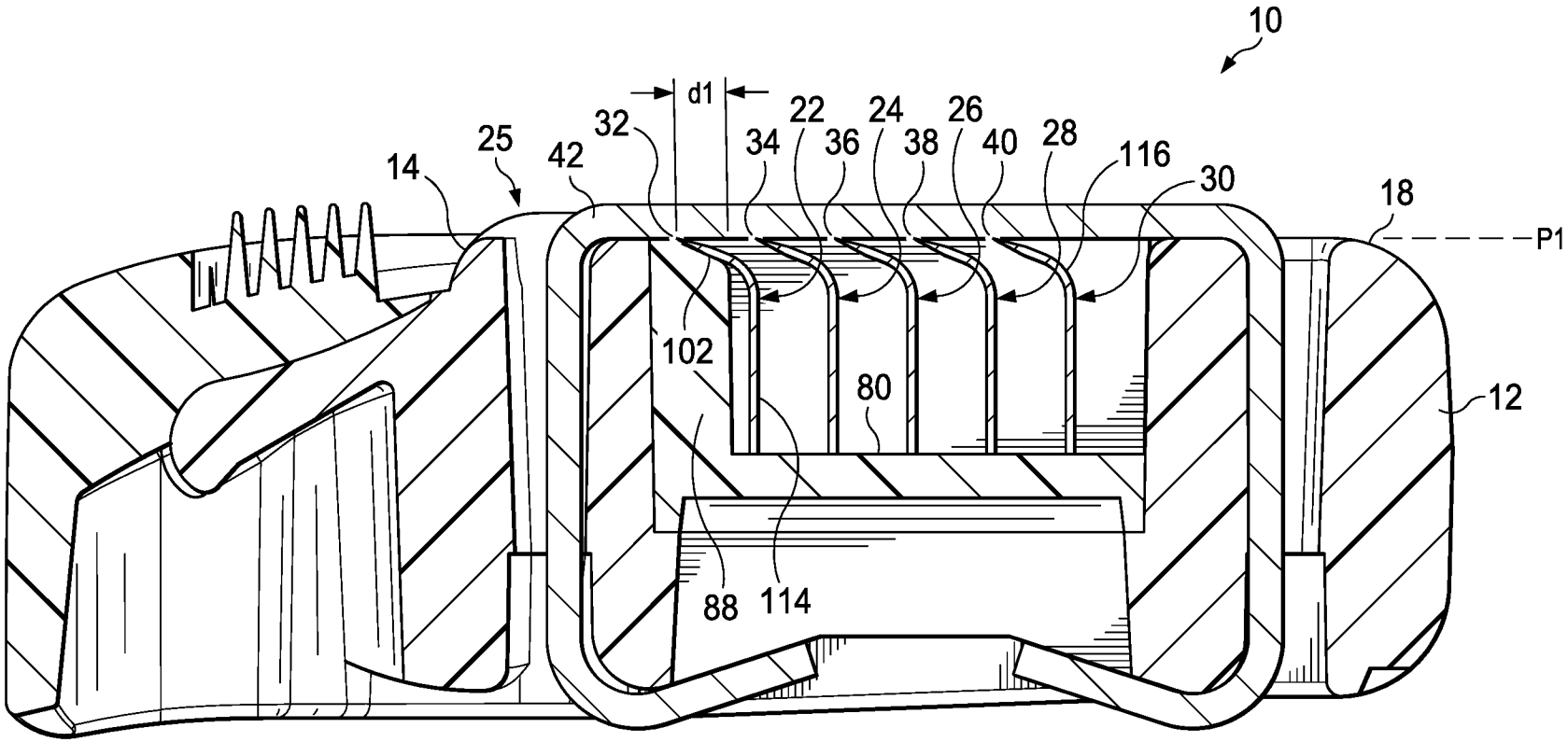
FIG. 4 is a cross sectional view of the shaving razor cartridge, taken generally along the line 4-4 of FIG. 1.

Referring to FIG. 4, a cross section view of the shaving razor cartridge 10 is shown, taken generally along the line 4-4 of FIG. 1. One or more of the blade members 22, 24, 26, 28 and 30 may be a unitary bent blade unit. For example, blade member 22 may comprise a unitary member having a vertical base 114 and respective bent portion 116 between the cutting edge 32 and the vertical base 114. The vertical base 114 may be transverse to the shaving plane P1 that is tangent to the guard 14 and the cap 18. It is understood that the other blade members 24, 26, 28 and 30 may also have a similar construction. In other embodiments, the one or more of the blade members 22, 24, 26, 28 and 30 may be welded blade assemblies (e.g., a blade welded having a cutting edge connected to a blade support having a base portion and a bent portion).

In FIG. 4, only the blade stabilizer 88 is shown in the cross section view because it is understood that the blade stabilizer 90 is essentially the same as the blade stabilizer 88 with the same relative orientation, construction and functions. In certain embodiments, the blade stabilizers 88 (and 90, not shown) may be spaced apart from each other and positioned directly under the corresponding blade retention members 42 (and 44, not shown). The positioning of the blade stabilizers 88 and 90 may improve securement of the blade members 22, 24, 26, 28 and 30, cutting efficiency and rinsibility. It is believed, without being held to theory, that the forces acting on the blades of a multiple blade system are highest for the blade closest to the guard. For example, in FIG. 4, the primary blade 22 would see the highest forces because the primary blade member 22 is the first blade member to engage and cut hairs during a shaving stroke. Accordingly, the primary blade member 22 engages and cuts the most hair and the longest hairs compared to any of the trailing blades 24, 26, 28, and 30. Since the primary blade member 22 may be subjected to the most force, the primary blade member 22 may require a greater degree of constraint to prevent undesirable movement of the cutting edge 32. Furthermore, it is believed, without being held to theory, that the forces acting on the primary blade 22 are highest at the cutting edge 32. Thus, it may be most beneficial to constrain the blade member 22 at the cutting edge 32 where the most force is applied to minimize undesired movement of the cutting edge 32 and/or the blade member 22. Furthermore, it may be unnecessary to provide similar constraint to some or all the other blade members 24, 26, 28 and 30 because they may be exposed to less force. It is understood that the area where the cutting edge 32 is constrained or clamped between the blade retention members 42 and 44 and the respective blade stabilizers 88 and 90 may not cut hair. Consequently, the cutting edge 32 need not have any specific sharpness to cut hair and may simply be an edge or end of the primary blade member 22. Accordingly, the area required to sufficiently constrain the cutting edge 32 may be optimized versus the area of the cutting edge 32 exposed to cut hair.

The blade retention members 42 (and 44 not shown) may be mounted to the top surface 25 of the housing 12 to facilitate securement of the blade members 22, 24, 26, 28 and 30 to the housing 12. The primary blade member 22 may be bent such that an angle of the vertical base 114 relative to the bent portion 116 is similar or the same as the angle of the top surface(s) 102 (and 104, not shown) of the blade stabilizers 88 (and 90, not shown), thus providing increased contact and support of an area from the cutting edge 32 toward the bent portion 116. In certain embodiments, the shaving razor cartridge 10 may provide for a greater degree of constraint for the primary blade member 22 compared to the trailing blade members 24, 26, 28 and 30. Movement of the primary blade member 22 may be reduced by constraining the primary blade member 22 at the cutting edge 32 in addition to constraining the vertical base 114 of the primary blade member 22. Accordingly, the vertical base 114 and the cutting edge 32 are both supported (i.e., the vertical base 114 may be supported by the blade registration members 80 and 82 (shown in FIG. 3) and the cutting edge 32 may be supported by the blade stabilizers 88 and 90 (shown in FIG. 3)).

The primary blade member 22 may be constrained between the blade stabilizers 88 and 90 and the respective blade retention members 42 and 44 along a distance "d1" of the blade member 22 from the blade edge 32 toward the bent portion 116. In certain embodiments, d1 may be about 0.40 mm to about 0.80 mm. The blade stabilizers 88 and 90 may be spaced apart from vertical base 114 and/or bent portion 116 to allow for easy assembly of the primary blade member 22 into the housing 12. For example, at least one of the blade stabilizers 88 and 90 may be spaced more than 0.15 mm from the vertical base 114 of the primary blade member 22. Thus, d1 may allow for sufficient constraint of the cutting edge 32, but still allow for ample spacing for mounting of the primary blade member 22 to the housing 12. The blade stabilizers 88 and 90 may extend beyond the cutting edge 32.

The blade stabilizers 88 and 90 may comprise an elastomeric material to allow the cutting edge 32 to be constrained, but not damaged. For example, the blade stabilizers 88 and 90 may comprise an elastomeric material having a Shore A hardness of about 30 to about 60. Harder materials may damage the cutting edge 32, which may lead to an uncomfortable and/or inefficient shave. In addition, an elastomeric material may allow the cutting edge 32 and an area between the cutting edge 32 and the bent portion 116 of the primary blade 22 to depress into the respective blade stabilizer 88 and (90 not shown), thus improving support and securement of the cutting edge 32. It is understood that additional blade stabilizers, similar to the blade stabilizers 88 and 90 described above, may also be used to support and constrain the cutting edges 34, 36, 38 and 40 in a similar fashion.

Figure 5:
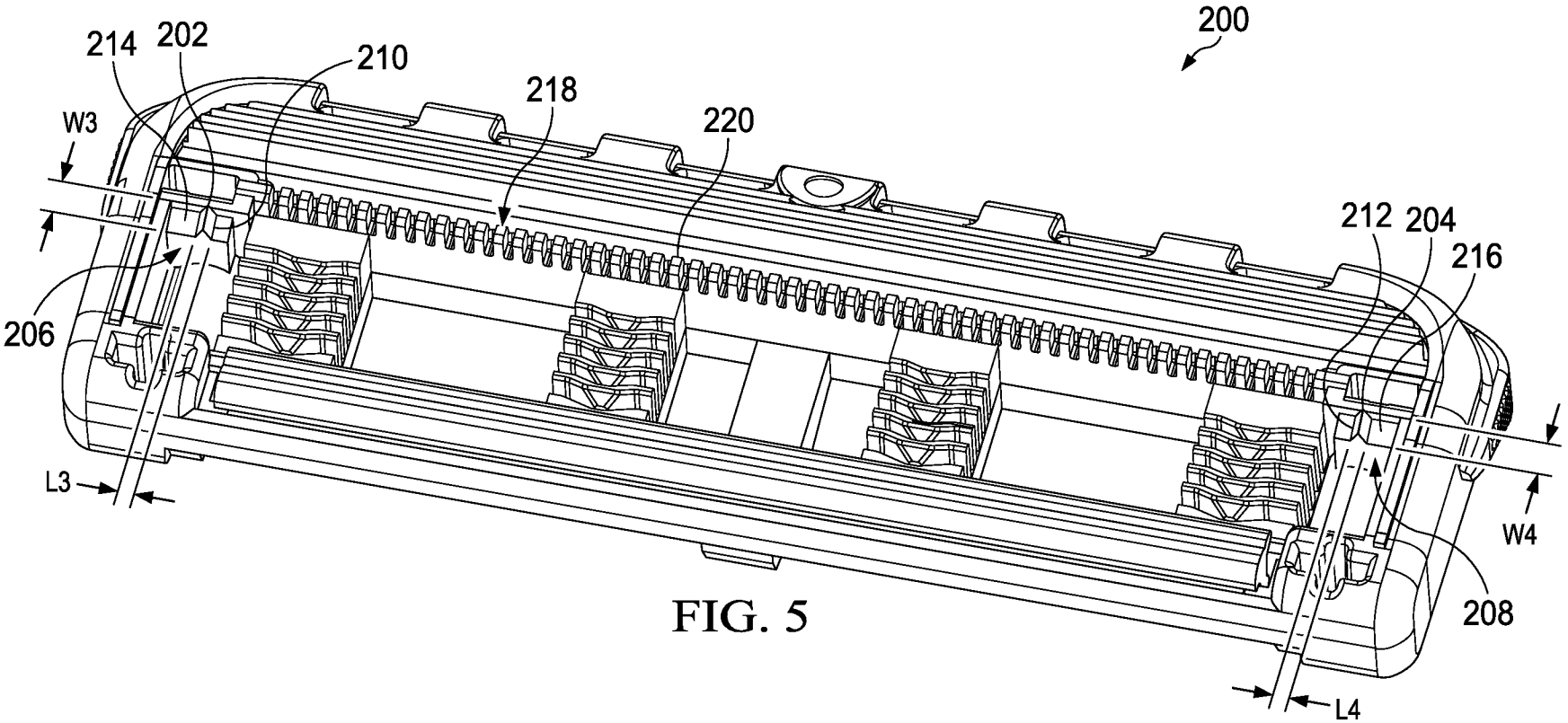
FIG. 5 is a perspective view of another possible embodiment of a housing for a shaving razor cartridge.

Referring to FIG. 5, a perspective view of a housing 200, which may be incorporated into the shaving razor cartridge 10 of FIG. 1, is illustrated. The housing 200 may be substantially the same as the housing 12 previously described in FIGS. 1-4. However, the housing 200 may include at least one protrusion 202 and 204 extending from at least one pair of blade stabilizers 206 and 208 mounted to the housing 200. The blade stabilizers 206 and 208 may be the same as the blade stabilizers 88 and 90 previously described. The protrusions 202 and 204 may have base 210 and 212 that tappers to a narrower top surface 214 and 216 of the respective protrusion 202 and 204. In certain embodiments, the protrusions 202 and 204 may have a height from the base 210 and 212 to the respective top surface 214 and 216 of about 0.25 mm to about 0.50 mm. In certain embodiments, the housing 200 may have a guard 218, similar to the guard 14 previously described, with a top surface 220 positioned a horizontal distance above the protrusions 202 and 204 (i.e., top surfaces 214 and 216) may be about 0.05 mm to about 0.30 mm. The protrusions 202 and 204 may have a respective width W3 and W4 of about 0.25 mm to about 2.0 mm and more preferably about 0.5 mm to about 1.0 mm. In certain embodiments, W3 and W4 may be less than or equal to W1 and W2. The protrusions 202 and 204 may also have a respective length L3 and L4 of about 0.1 mm to 1.0 mm. The primary blade member 22 (not shown) may contact compress the protrusion 202 during assembly to improve the constraint of the cutting edge 32 by applying more force to the primary blade member 22. Although only one pair of blade stabilizers 88 and 90 (FIGS. 1-4) and 206 and 208 (FIG. 5) are illustrated, it is understood that more blade stabilizers may be used to increase constraint on the cutting edge 32 and/or the blade stabilizers may also be incorporated to fix any number of additional blade members. The protrusions 202 and 204 may allow more force to be applied to the cutting edge 32 without damaging the cutting edge 32.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of assembling a razor cartridge comprising:

injection molding a housing;

co-injection molding an elastomer to the housing to form a pair of laterally spaced apart blade stabilizers;

mounting a primary blade member having a cutting edge to the housing;

contacting the cutting edge of the primary blade member with a top surface of the laterally spaced apart blade stabilizers;

mounting one or more clips to a top surface of the housing;

directly contacting lateral ends of the cutting edge of the primary blade member with the one or more clips to constrain the cutting edge between the one or more clips and the pair of laterally spaced apart blade stabilizers.

2. The method of claim 1 further comprising mounting a plurality of additional blades to the housing, each of the additional blades having a respective cutting edge.

3. The method of claim 2 further comprising biasing the cutting edge of the primary blade member against the one or more clips.

4. The method of claim 3 further comprising biasing the cutting edges of the plurality of additional blades against the one or more clips.

5. The method of claim 1 wherein said mounting the one or more clips to the top surface of the housing comprises mounting a pair of clips to the housing.

6. The method of claim 1 wherein said mounting the primary blade member to the housing comprises mounting one or more unitary blade units.

7. The method of claim 1 further comprising providing a protrusion on each of the laterally spaced apart blade stabilizers.

8. The method of claim 7 wherein each of the protrusions has a triangular shape.

* * * * *